United States Patent [19]

Lam

[11] 4,425,764

[45] Jan. 17, 1984

[54] MICRO-CRYOGENIC SYSTEM WITH PSEUDO TWO STAGE COLD FINGER, STATIONARY REGENERATIVE MATERIAL, AND PRE-COOLING OF THE WORKING FLUID

[75] Inventor: Calvin K. Lam, Bedford, N.H.

[73] Assignee: Kryovacs Scientific Corporation, Amherst, N.H.

[21] Appl. No.: 358,620

[22] Filed: Mar. 16, 1982

[51] Int. Cl.[3] ..... F25B 9/00

[52] U.S. Cl. ..... 62/6; 60/520; 165/10

[58] Field of Search ..... 60/520; 62/6; 165/10

[56] References Cited

U.S. PATENT DOCUMENTS

| | | | |
|---|---|---|---|
| 3,148,512 | 9/1964 | Hoffman et al. | 62/6 |
| 3,224,187 | 12/1965 | Breihan | 62/6 |
| 3,523,427 | 8/1970 | Simpson | 62/6 |
| 3,650,118 | 3/1972 | O'Neil | 62/6 |
| 3,969,907 | 7/1976 | Doody | 62/6 |
| 3,991,586 | 11/1976 | Acord | 62/6 |
| 4,078,389 | 3/1978 | Bamberg | 62/6 |
| 4,090,859 | 5/1978 | Hanson | 62/6 |
| 4,092,833 | 6/1978 | Durenec | 62/6 |
| 4,206,609 | 6/1980 | Durenec | 62/6 |

OTHER PUBLICATIONS

Comparing Closed-Cycle Cryocoolers, Chellis, reprinted from Nov., 1979 Electro-Optical Systems Design.

Walker, G., *Stirling Engines* pp. 42; 43 (1980).

Walker, G., Document pp. 3.100 to 3.103.

*Primary Examiner*—Ronald C. Capossela

*Attorney, Agent, or Firm*—Kenway & Jenney

[57] ABSTRACT

A miniature cryogenic system preferably operating in a manner similar to a split Stirling cycle utilizes a cold finger with a solid, low weight displacer and a stationary regenerative material external to the displacer. The regenerative material preferably surrounds the displacer and extends from a fluid inlet to a cooled end plate of a housing. The displacer has a central channel that receives an auxiliary displacer that carries a regenerative material in an internal cavity. A second fluid inlet located at the end of the housing opposite the cooled end communicates with the regenerative material held in the auxiliary displacer. The main and auxiliary displacers preferably have associated heat exchangers at their cooling ends and the cooling end of the auxiliary displacer is located to pre-cool the fluid passing from the first inlet to the cooled end plate.

14 Claims, 7 Drawing Figures

MICRO-CRYOGENIC SYSTEM WITH PSEUDO TWO STAGE COLD FINGER, STATIONARY REGENERATIVE MATERIAL, AND PRE-COOLING OF THE WORKING FLUID

BACKGROUND OF THE INVENTION

This invention relates in general to cryogenic cooling systems. More specifically it relates to miniature split cryogenic systems with the compressor section separated from the cooling section and the compressor operating with a split phase.

Miniature cryogenic cooling systems are widely use to cool crystals used as transducers. The cooling reduces lattice vibrations which would otherwise obscure or degrade the quality of the output signal. A particularly important application is in the cooling of the infrared sensing material for night-vision or heat-seeking devices. Miniature cryogenic systems are also useful for medical applications such as the freezing of small quantities of brain tissue in the treatment of Parkinson's disease. While the requirements of a cryogenic system will vary depending on the use, some typical considerations are its operating efficiency, durability, compactness, weight, microphonics (typically vibrations from the compressor motor, a compressed gas, or the physical impact of moving components in the system), and thermophonics (which may be defined as electronic white noise generated by heat conducted from the warmer to the colder portion of the system). For applications involving infrared sensors for airborne devices, all of these factors are important.

One system presently used in military equipment and dicussed in an article by Franz Chellis, "Comparing Closed-Cycle Cryocoolers" in the November, 1979 issue of Electro-Optical Systems Design is an integral Stirling cycle system, that is, one with the compressor and expander forming a single mechanical package. The expander is an elongated cylindrical structure commonly termed a "cold finger" since it is finger shaped and the cryogenic cooling occurs at its extreme tip end. A motor drives a compressor piston and the displacer through a lubricated helical gear. A flywheel is mounted on the motor shaft in an attempt to control the vibrations produced by the motor and to prevent their transmission to the expander. The piston compresses a working fluid, typically a low freezing temperature gas such as helium, that is conducted to the expander. The pressurized gas moves through an axially reciprocating displacer in a manner that cools a working volume between an end of the displacer and an end plate of the cold finger housing. The gas flow to this region is through a regenerative material, or regenerator, held in the displacer. The regenerator acts as a heat exchanger and maintains a temperature gradient between the cold tip of the cold finger and the gas inlet. The regenerator is often a metallic screen or small spheres of copper or nickel. In any event, the regenerator has a comparatively large mass.

A major disadvantage of this device is that despite the flywheel, there is a significant transmission of motor vibration to the cold finger. For many applications, the irreducible level of vibration is unacceptable. Another problem inherent in this integral system is that the lubricant for the helical gear breaks down and can recondense to clog fluid flow passages. Seal wear has the same disadvantage and in addition it can allow fluid leakage that detracts from the efficiency of the system.

This system is also comparatively heavy (approximately four pounds), bulky (the compressor section measures approximately 4½ inches by 3½ inches and the cold finger extends three to four inches), and has a typical operating life of only 300 to 500 hours. The weight, bulkiness and microphonics problems of this system make it particularly poor for certain uses in airborne missiles.

U.S Pat. No. 4,078,389 to Bamberg describes another cooling system which in different embodiments uses either the Stirling cycle or the Vuillieumier cycle. Bamberg attempts to solve problems associated with connecting a rotating drive shaft to a pair of linearly reciprocatng pistons 180° OFF-phase with each other. In the Stirling cycle form, an eccentrically mounted crank arm drives a doubly articulated connecting link which in turn drives the pistons and the displacer in a generally linear path. In a Vuillieumier cycle form, a scotch yoke connected to a rotating, eccentrically mounted crank to produces a generally linear drive force for a pair of pistons. These arrangements have two major disadvantages. First, as in the above described apparatus, the motor is mechanically coupled directly to the displacer. Control of microphonics is therefore extremely difficult. Second, the drive systems apply the drive force over a comparatively long moment arm which develops a significant side thrust on the main seals. As a result, they are prone to rapid wear and failure.

In an attempt to isolate the vibration of the compressor from the cold finger, split Stirling devices are known which separate the compressor section from the cold finger by conduits that carry the working fluid. U.S. Pat. Nos. 4,090,859 and 3,991,586 describe a single compressor, single split Stirling system. U.S. Pat. Nos. 4,206,609 and 4,092,833 describe compound-compressor dual-split Stirling systems. A common design problem of these systems is the control of the acoustic noise generated by a free oscillating dispenser slamming back and forth against containment surfaces within the cold finger. Noise is especially troublesome in any single split Stirling system.

To control the movement of the displacer, U.S. Pat. No. 4,090,859 uses an enclosed pneumatic air spring located at the end of the cold finger opposite the cryogenically cooled end. U.S. Pat. No. 3,991,586 uses a spring and a solenoid to control the movement of the displacer. Both systems are, nevertheless, plagued by the host of problems recited in the '609 patent. For example, the high frequency of operation of the device leads to large acceleration and deceleration forces. The large forces associated with oscillating the displacer produce vibration microphonics despite the effects of pneumatic and mechanical springs. Another problem is the wear of friction seals particularly where the degree of friction is important in controlling the displacer motion. Still another problem is heat due to friction or due to gas compression in the pneumatic volume. Radiating fins can be used to assist dissipation, but they increase the size of the device. Also, no known single-split Stirling system has an acceptable repeatable operating life. A typical operating life is 10 hours.

U.S. Pat. Nos. 4,092,833 and 4,206,609, both to Durenec, describe systems where not only is the compressor physically separated from the cold finger, but also it operates on a split phase. The compressor has two pistons that develop gas pressure in separate conduits that are connected to separate chambers in the cold finger. In the '833 patent the compressor cylinders operate 180° out of phase and one piston has a smaller effective area than the other piston, This results in a dual-split, "push-pull" mode of operation at the cold finger one compressor cylinder is developing a suction in one chamber that assists the compression developed by the other compressor cylinder in the other chamber. In the '609 patent, two pistons, again of different size, operate 90° out of phase with the larger piston cylinder driving waves of compressed gas through a large displacer to the volume to be cooled. The smaller piston feeds a smaller, stationary displacer received in the end of the large displacer opposite the cooled end. This arrangement also provides a "push-pull" mode of operation. In one form, the conduit from the large piston cylinder to the main displacer is wrapped around the "warm" end of main displacer where a small displacer is enclosed, to precool the gas supplied to the main displacer. The '609 patent also describes a multi-stage displacer where the working gas flows toward the cooled end through multiple regenerators of decreasing volume. The regenerator in the displacers in all of the single-split and dual-split systems discussed above is carried within the displacer which oscillates primarily in response to applied fluid pressures.

The Durenec designs, however, also have drawbacks. A principal problem with the '833 arrangement is that the pressure waves developed in the "rear" volume do not effectively control microphonics and overcome acceleration and deceleration problems. The principal drawback of the '609 system is that the system does not effectively control the vibration problems associated with a displacer having a large mass and oscillating at a high frequency.

It is therefore a principal object of this invention to provide a miniature cryogenic system which is highly efficient, compact and characterized by a low level of microphonics and thermophonics.

Another principal object is to provide such a system operating on a dual-split, "compound" Stirling cycle that has a comparatively long operating life.

A further object is to provide such a system, including a split-phase compressor, which is highly compact and has a significant weight reduction as compared to known systems.

Another object is to provide a system with the foregoing advantages that reduces seal wear and avoids problems associated with lubricant breakdown.

A still further object is to provide a system with all of these advantages that is formed of conventional materials and has a competitive cost of manufacture.

SUMMARY OF THE INVENTION

A miniature cryogenic cooling system according to this invention has a cold finger with a displacer that is free to reciprocate along its longitudinal axis within a surrounding, usually cylindrical, housing that includes an end plate that is in contact with a thermal load. The housing has a main inlet that receives a working fluid from one cylinder of a split-phase compressor and a secondary inlet that receives the working fluid from the other cylinder. The main inlet feeds a working fluid to one end of a stationary regenerative material located in an annular volume between the housing and the displacer. The displacer is solid and preferably formed of a light weight material such as nylon. The end of the displacer adjacent the end plate preferably has a stepped configuration which cooperates with a set of mutually spaced apart discs that act as a heat exchanger.

An auxialiary displacer is received in a channel formed in the end of the main displacer opposite the end plate and carries a regenerative material at its interior. The second inlet supplies the working fluid to one end of the regenerative material. The opposite end of the auxiliary displacer also preferably has a step-like recess at its edge which in conjunction with fluid flow passages at the base of the recess promote heat transfer at a working volume inside the main displacer. This volume is cooled by the auxiliary displacer and the associated fluid flows and is located between the main inlet and the end plate to pre-cool the fluid flow through the main regenerator and thereby reduce its temperature gradient. This arrangement, when operated in the Stirling mode, produces a "compound" Stirling cycle characterized by two closed loop working cycles on a pressure-volume diagram that are generally "kidney" shaped.

The main displacer is preferably surrounded by a sleeve that extends from a baffle located at the "warm" end of the regenerative material to the heat exchanger at the cold end. Conventional seals bridge the housing-displacer gap, guide the movement of the displacer, and block any blow-by flow of the working gas. Besides pre-cooling the main fluid flow, the auxiliary displacer also operates with a push-pull phase difference with respect to the main displacer to increase operating efficiency and to control the movement of the main displacer using differential pressure waves applied at its opposite ends. This push-pull action, together with the comparatively low mass of the main displacer, results in a significant reduction in microphonics and seal wear and provides a long average operating life. The length to diameter ratios of both displacers is preferably at least 2:1.

These and other features and objects will be more fully understood from the following detailed description which should be read in light of the accompanying drawings.

DETAILED DESCRIPTION OF THE PREFERRED EMBODIMENTS

Figure 1:
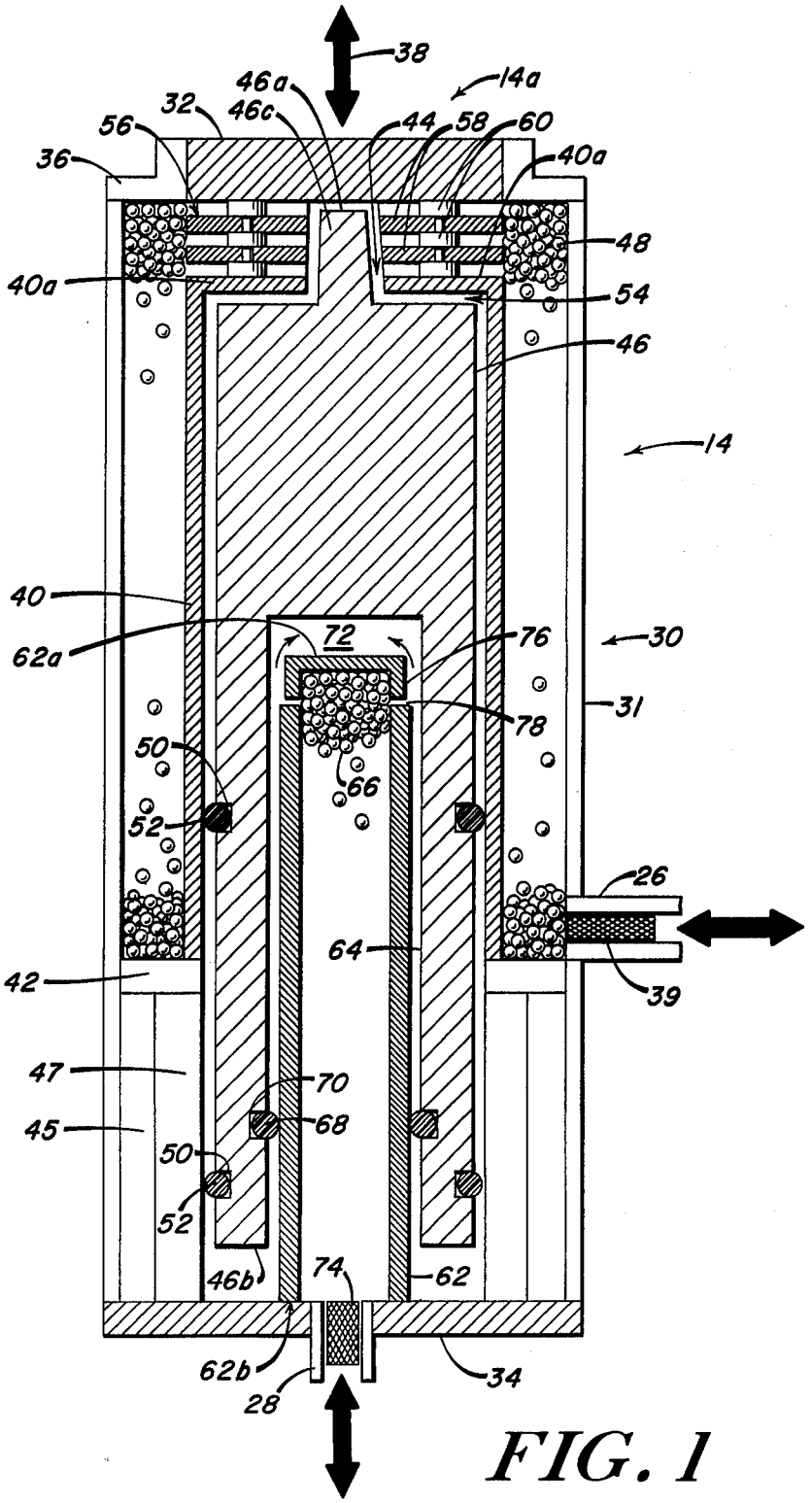
FIG. 1 is a view in vertical section of a cold finger assembly according to this invention suitable for operation in a dual-split, "compound" Stirling cycle.
Figure 2:
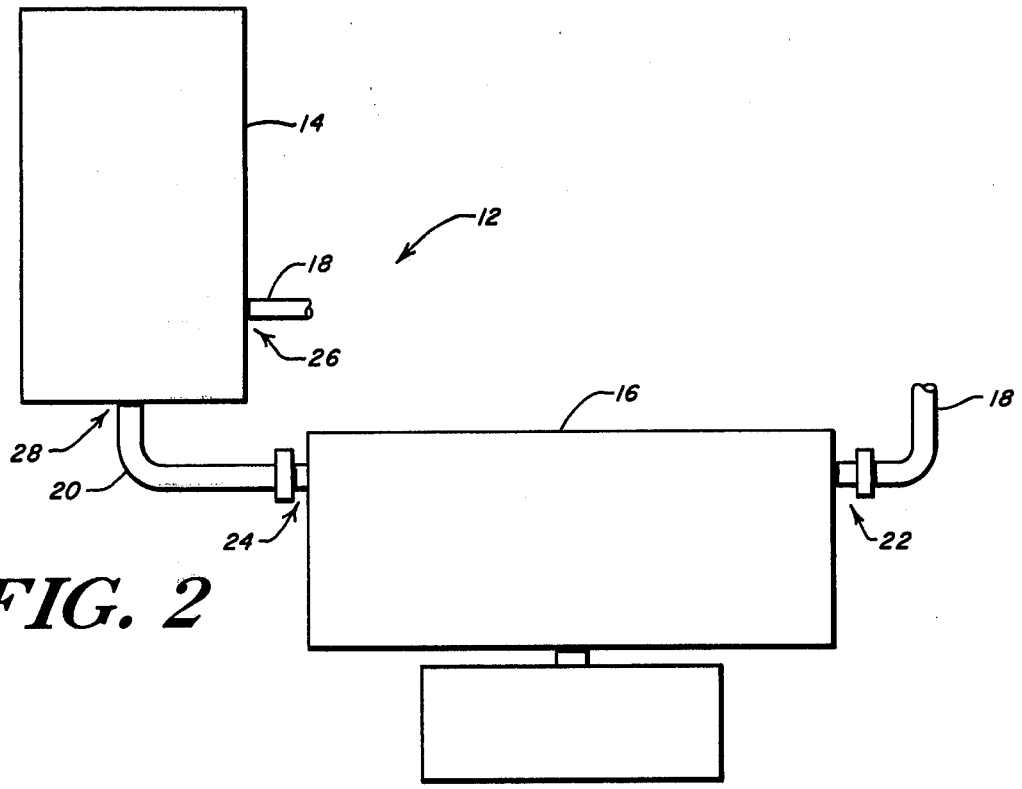
FIG. 2 is a side elevational view partial in vertical cross section with portions broken away of a miniature cryogenic system according to the present invention utilizing the cold finger assembly shown in FIG. 1 and a split phase compressor.

FIGS. 1 and 2 show a miniature cryogenic cooling system 12 that includes a cold finger assembly 14, a split phase compressor 16 and conduits 18 and 20 which connect outlets 22 and 24 of the compressor to inlets 26 and 28 of the cold finger, respectively. While the system shows these elements with a particular orientation and dimensions, it will be understood that the dimensions can assume a wide range of values and that the relative positioning of the components will depend on a variety of factors such as the physical constraints of the end use environment and the degree of separation desired between the compressor and the cold finger to achieve a given level of microphonics and the thermal load. The compressor operates on a working fluid, typically a low freezing temperature gas such as helium, which is conducted by the conduits 18 and 20 to the two separate working volumes 54, 72 in the cold finger. The compressor generates pressure waves in the gas which perform work in both working volumes in a Stirling mode of refrigeration to cool to cryogenic temperatures a tip 14*a* of the cold finger adjacent the thermal load.

The cold finger 14 has an external housing 30 including a generally cylindrical side wall 31, an end plate 32, and an opposite end plate 34. The housing is formed of any suitable structural material such as stainless steel with the exception of the end plate 32 adjacent the thermal load which is preferably formed of a material such as copper having an excellent thermal conductivity. The plate 32 is brazed to a mounting ring 36 which in turn is welded to the side wall 31. The housing is sealed against gas flows except for the inlets 26 and 28. The inlet 26 is located in the side wall 31 and the inlet 28 is located in the end plate 34, preferably at a point generally aligned with the central longitudinal axis of the housing 30 indicated by arrow 38. The inlet 26 holds a filter element 39.

A sleeve 40 is secured within the housing generally coaxial with the walls 31. The lower end of the sleeve, as shown, is welded to a baffle 42 in the form of an annular ring. The sleeve and the baffle are preferably formed of stainless steel. The sleeve terminates in an annular end portion 40*a* that is generally parallel to the end plate 32 with a central opening 44. The outer diameter of the sleeve 40 is generally aligned with the circumference of the end plate 32. The baffle 42 is supported on a pair of concentric members 45 and 47 that extend axially from the end plate 34 to the baffle and radially from the inner diameter of the baffle to the wall 31.

Principal features of this invention are a displacer 46 and a stationary regenerative material 48 that is external to the displacer. The displacer 46 is a solid member and is preferably formed of a light weight plastic material such as nylon. This construction yields a displacer having a markedly lower mass than any displacer presently in use in conjunction with miniature cryogenic coolers operating on the Stirling cycle and therefore will generate less microphonic noise. The displacer has a generally cylindrical configuration and is located coaxially within the sleeve 40. Circumferential grooves 50,50 formed in the displacer each hold a conventional seal 52,52. The grooves are large enough to reliably seat the seal while allowing them to extend radially beyond the outer surface of the displacer into a sliding contact with the inner surface of the sleeve 40. The seals 52,52 perform the usual functions of locating the displacer, blocking a bypass of the working gas, and providing a sliding frictional seal. With respect to the last function, the displacer is shorter than the interior clearance in the housing measured along the axis 38 to provide a slight clearance between the extreme end surfaces 46*a* and 46*b* of the displacer. A typical maximum value for this clearance is approximately $\frac{1}{8}$ inch. The clearance together with the mounting arrangement within the sleeve 40 allows the displacer to reciprocate linearly along the axis 38 between one extreme position where the surface 46*a* abuts the end plate 32 and another extreme position where the surface 46*b* abuts the end plate 34. One advantage of the present invention is that the system allows the use of a displacer that has a good length to diameter ratio which is effective in reducing seal wear.

The regenerative material 48 is located in and totally fill up an annular volume surrounding the displacer defined by the sleeve 40, the wall 31, the baffle 42 and the inner surface of the ring 36. The material is shown as small spheres of a metal such as copper or nickel. Other conventional materials such as a metallic screen are also acceptable. The material 48 performs the usual regenerative functions of providing a heat sink/heat source for the working gas that flows through it and maintaining a temperature gradient between the cold end 14*a* of the assembly and the "lower" or warm end of the material adjacent the inlet 26 and the baffle 42. Gas flows back and forth through the material 48 in response to pressure waves produced by the compressor 16 in the line 20. The flow terminates at a first working volume 54 located between the end plate 32 and the adjacent end surface of the displacer.

A heat exchange assembly 56 is located in the volume 54 to promote an efficient transfer of heat from the end plate 32 to the gas. The assembly 56 includes a stack of discs 58,58 separated by spacers 60. The discs are preferably copper to facilitate the heat transfer and are oriented generally parallel to the end plate 32. The spacers are brazed or welded to the discs and are also preferably formed of copper. The spacing between the discs is sufficiently small that the spheres of the regenerative material 48 cannot enter the volume 54. (The filter 39 in the inlet 26 also functions to hold the spheres in the annular volume.) The discs extend radially from an outer diameter that is generally aligned with the outer surface of the sleeve 40 to an inner diameter that is spaced from a generally mating central projection 46*c* of the displacer that terminates in the surface 46*a*. The heat exchanger assembly 56 provide a flow path for the gas entering and leaving the volume 54 which enhances heat transfer through a turbulence in the flow and an exposure of the gas flow to additional heat transfer surfaces.

In the preferred form illustrated in FIG. 1, the cold finger 14 also has an auxiliary displacer 62 that is smaller than the main displacer 46, both in length and diameter, and is received in a central, axially aligned bore 64 formed in the "warm" end of the main displacer adjacent the end plate 34 and the inlet 28. In contrast to the displacer 46, the auxiliary displacer has a central cavity that is filled with a regenerative material 66 that can be of the same type as the material 48. A seal 68 held in a groove 70 formed on the inner wall of the bore 64 blocks any leakage of the working gas from a second working volume 72 located at the end of the bore 64 under the cold end 62*a* of the displacer.

The displacer 62 is stationary with respect to the housing with its "lower" edge 62*b* secured to the end plate 34. A plug 74 held in the inlet 28 (which can also function as a gas filter) prevents the regenerative material 66 from falling out of the interior of the displacer. Gas flows through the material 66 between the inlet 28 and the volumne 72. The cool end 62*a* of the displacer 62 has a recess 76. For a miniature displacer 62 with typical overall length of two inches and a typical diameter of 0.175 inches for the bore 64, the recess 76 can have a setback of 0.003 inch. Gas flow passages 78 are formed in the displacer at the base of the recess to provide a gas flow path between the interior and the exterior of the displacer. This recess and flow passage arrangement increases the turbulence of the gas flow into the volumne 72 resulting in an increased heat exchange efficiency.

Figure 3A:
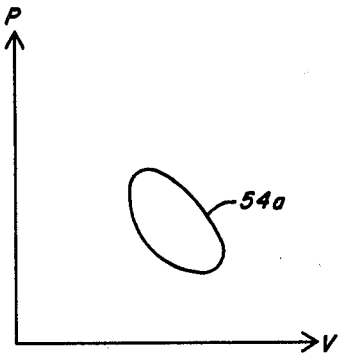
FIG. 3*a* is a pressure-volume or work diagram for the main cryogenically cooled working volume of a dual-split, compound Stirling cycle system of the type shown in FIGS. 1 and 2.
Figure 3B:
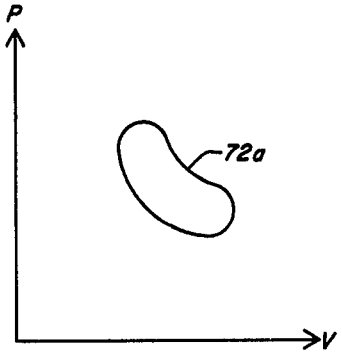
FIG. 3*b* is a diagram corresponding to FIG. 3*a* for the auxiliary working volume that pre-cools the gas flowing to the main working volume.
Figure 3C:
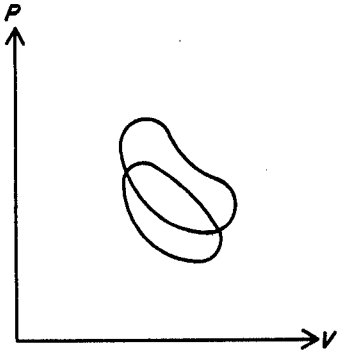
FIG. 3*c* is a diagram corresponding to a superimposition of FIG. 3*a* on FIG. 3*b* demonstrating the net cooling for the entire system.

A significant feature of the present invention is that the cooling volumne 72 associated with the auxiliary displacer is located sufficiently far into the body of the main displacer that it lies between the inlet and the main working volumne 54, and preferably well "above" the inlet 26 (as shown). This arrangement utilizes the cooling produced in the volume 72 to "pre-cool" the gas flow in the main regenerative material 48. This significantly reduces the axial temperature gradient in the regenerative material 48 which in turn results in an increased efficiency of operation and a reduction in thermophonics. This arrangement can be characterized as a "pseudo" two stage system since it provides a precooling, but the configuration and function of the stages differs from the normal multi-stage arrangement described, for example, in U.S. Pat. No. 4,206,609 to Durenec. This arrangement also operates on what applicant terms a "compound" Stirling cycle illustrated in FIGS. 3*a*–3*c*. The net cooling produced by the worked performed on the gas in the volume 54 is illustrated by the "kidney" shaped loop or work cycle 54*a* in FIG. 3*a*. The net cooling produced at the volume 72 is illustrated on the pressure-volume (p-V) diagram by the loop 72*a* illustrated in FIG. 3*b*. FIG. 3*c* shows the loops 54*a* and 72*a* on the same p-V diagram. In this "compound" mode of operation, the loops 54*a* and 72*a* can be separate, partially overlapping (as shown in FIG. 3*c*), or substantially coincident. This "compound" Stirling cycle provides a more efficient cooling than conventional integral Stirling system or single-split Stirling systems.

Figure 5:
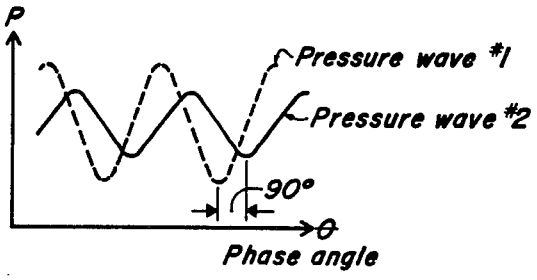
FIG. 5 is a graph showing the pressure waves as a function of phase angle in the two gas feed lines from the compressor to the cold finger assembly.

The compressor 16 can be of conventional design, but preferably is of the type described in a co-pending application of Peter Durenec and the present applicant for "Compact Split Phase Compressor for Micro-Cryogenic Systems" (Attorney's Docket No. KRY-LO-002) filed of even date and commonly assigned with the present application, the disclosure of which is incorporated herein by reference. The compressor preferably develops pressure waves in the lines 18 and 20 that are 90° out of phase. However, phase differences other than 90° can be used. The phase difference will, however, typically fall within the range of 60° to 120°. With any phase difference in this range, the increase of the pressure in one of the columes 54 or 72 is opposed by a pressure that is increasing to its maximum value in the other one of these volumes, but with a phase difference. This arrangement provides a beneficial "push-pull" coordination of the gas pressure levels in the volumes 54 and 72. The push-pull operation of the cold finger assembly is created by the pressure differential between the pressure waves in the conduits 18 and 20, which in turn is generated by the split phase compressor 16. The relationship between these pressure waves is illustrated in FIG. 5. The two pressure waves plotted in FIG. 5 occur in the conduits 18 and 20 and the working volumes 54 and 72, respectively. When high pressure is routed into the working volume 54, low pressure is directed to the working volume 72. In a cycle of operation, the situation is gradually switched so that high pressure is routed into the volume 72 and low pressure is routed into the volume 54. The combination of a high pressure condition in one working volume and a low pressure condition at the other working volume produces the "push-pull" mode of operation of the system on the displacer 46

The system 12 described above has numerous advantages when used in a miniature cryogenic system. First, as noted above, this design is highly compact. The entire system 12 can be accommodated in a compartment three inches square. The compressor and other systems elements are comparatively light, a total weight of 1½ pounds being possible as contrasted to present integral miniature airborne systems weighing 4½ pounds or more.

In operation the compressor 16 produces a sinusoidally varying pressure wave in the lines 18 and 20, and hence in the volumes 54 and 72. The waves in the two lines have a phase difference that varies from 60° to 120°, but is peferably 90°. This varying gas pressure in the volumes 54 and 72 drives displacer 46 rapidly back and forth in a linear reciprocating motion. The motion is resisted and controlled by the friction of the seals 52,52 and 68 as well as the pressure waves. As noted above, a significant aspect of the present invention is that the microphonics generated by the displacer 46 slamming into abutment surfaces within the housing 30 are significantly reduced by (1) the low mass of the solid displacer 46 and (2) the movement control produced by opposed pressures in the volumes 54 and 72 acting at opposite ends of the same movable member. It should be noted that the degree of control is, of course, also related to the area on which the gas pressure acts. In general the effective area presented to the gas pressure in the volume 54 is at least twice that presented to the gas pressure in the volume 72. This area differential is somewhat offset, however, by variations in the pressure developed in the lines 18 and 20. It is also significant to note that the cryogenic cooling system of the present invention can operate efficiently with all of the advantages enumerated above at all practical average pressure levels including comparatively low gas pressures, e.g. under 300 psi.

There has been described a miniature cryogenic cooling system which can operate on a dual-split, compound Stirling cycle in a split phase and "push-pull" mode that is highly efficient, produces a low level of microphonics and thermophonics, compact, low weight and has a comparatively long operating life. The system produces acceptable levels of seal wear both in the compressor and cold finger and uses no lubricants which can break down in operation. The cold finger provides an enhanced heat exchange at the working volumes and uses pre-cooling generated by an auxiliary displacer to produce a comparatively low temperature gradient along the regenerator. All of these advantages are achieved using a relatively uncomplicated construction.

Figure 4:
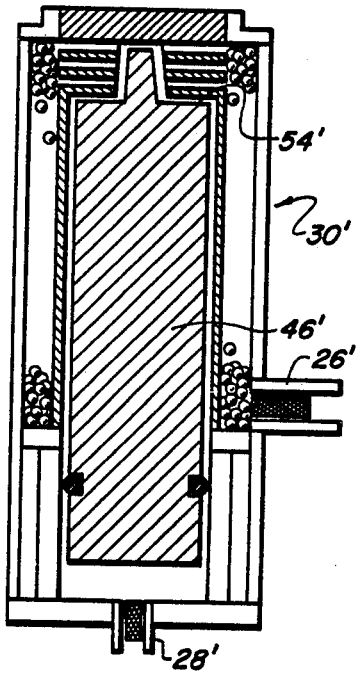
FIG. 4 is a simplified view in side elevation corresponding to FIG. 1 of an alternative cold finger assembly according to the present invention that does not employ an auxiliary displacer.

While the invention has been described with reference to its preferred embodiment, it will be understood that it may be practiced using a wide variety of modifications and alterations which will occur to those skilled in the art from the foregoing detailed description and the accompanying drawings. One modification is illustated in FIG. 4. The cold finger assembly shown there is the same as that shown in FIG. 1 except that there is no auxiliary displacer mounted for axial reciprocating motion within a main displacer 46′ (like parts in FIGS. 1 and 4 having the same reference numbers, but distinguished by a prime). Gas flowing through the inlet 28′ acts on the "lower" or "warm" end surface 46*b*′ of the displacer to develop the "push-pull" mode of operation described above with reference to FIGS. 1 and 4. A major disadvantage of this arrangement is that there is substantially no pre-cooling of the working gas flowing through the inlet 26′ to the main working volume 54′. Other variations and modifications of the invention include operating on other cycles such as Vuillieumier and Gifford-McMahon. These and other modifications and alterations are intended to fall within the scope of the appended claims.

What is claimed is:

1. In a miniature cryogenic system having a compressor with two outlets, first and second conduits carrying a working fluid each connected at one end to the outlets pressurized in a split phase relationship by said compressor, wherein the improvement comprises:

an elongated housing having a first end that includes a surface oriented generally transversly to said housing that is cryogenically cooled and a second end opposite said first end;

a displacer located within said housing with its longitudinal axis generally aligned with that of said housing;

means for mounting said displacer for a longitudinal reciprocating movement, said displacer having a first end adjacent said first end of said housing that together with said first housing end defines a first working volume and a second end spaced longitudinally from said first end that together with said second housing end defines a second volume;

first fluid inlet means located in said housing and in fluid communication between said first conduit and said first working volume;

second fluid inlet means located in said housing and in fluid communication between said second conduit and said second volume;

means for restricting the flow of said working fluid between said first and second volumes; and a stationary regenerative material located in the flow path of said working fluid from said first inlet to said first volume.

2. The improvement according to claim 1 wherein said regenerative material extends longitudinally from said first inlet to said first housing end.

3. The improvement according to claim 2 wherein said displacer is solid.

4. The improvement according to claim 3 wherein said displacer is made of a light weight material.

5. The improvement according to claim 4 wherein said displacer is a plastic.

6. The improvement according to claim 5 further comprising heat exchanger means disposed in said first working volume.

7. The improvement according to claim 5 wherein said heat exchanger means comprises at least one annular disc that is spaced along the longitudinal axis of said housing from said cryogenically cooled surface.

8. The improvement according to claim 7 wherein said displacer mounting means comprises a sleeve that surrounds said displacer and has an end surface parallel to said cooled surface.

9. The improvement according to claim 8 wherein said at least one annular disc is mounted in parallel spaced relationship to said cooled surface and at least the adjacent portion of said first displacer end.

10. The improvement according to claim 9 wherein said discs are formed of copper or other metals and said spacing is selected to restrict the movement of said regenerative material into said first working volume.

11. The improvement according to claim 1 wherein the areas of said first and second displacer ends upon which the pressure of said working fluid in said first and second working volumes acts, respectively, have values selected in conjunction with the fluid pressure values in said first and second conduits and the phase difference between the pressure values in said first and second conduits to produce a push-pull mode of reciprocation of said displacer.

12. In a dual-split Stirling cycle cryogenic system having a split phase compressor with two independent outlets, first and second conduits carrying a working fluid each connected at one end to the outlets pressurized in a split phase relationship by said compressor, wherein the improvement comprises:

an elongated housing having a first end surface that is cryogenically cooled and a second end opposite said first end surface;

a displacer located within said housing with its longitudinal axis generally aligned with that of said housing;

means for mounting said displacer for a longitudinal reciprocating movement, said displacer having a first end adjacent said cooled end surface of said housing that together with said cooled end surface and adjacent portion of said housing defines a first working volume and a second end adjacent said second end of said housing;

first fluid inlet means located in said housing and a fluid communication between said first conduit and said first working volume;

second fluid inlet means located in said housing and in fluid communication between said conduit and a region adjacent said second displacer end;

seal means for restricting the flow of said working fluid between said first and second inlet means;

a stationary regenerative material located in the flow path of said working fluid from said first inlet means to said first volume; and second displacer means mounted for a reciprocating axial sliding movement in a bore within said first displacer, said second displacer carrying a regenerative material located at its interior and in a fluid flow path between said second inlet means and a second working volume defined by said bore and a first end of said second displacer.

13. The improvement according to claim 12 wherein said second volume is located longitudinally between said first inlet means and said first volume to provide a pre-cooling of the working fluid flowing between said first conduit and said first working volume.

14. The improvement according to claim 13 wherein said first end of second displacer has a recess and passages for the flow of said working fluid between said regenerative material carried by said second displacer and said second volume by way of said recess to provide an enhanced heat exchange at said second volume due to the turbulence of the fluid flow generated by said recess and said passages.

* * * * *